United States Patent [19]

Ekbom et al.

[11] 4,178,052

[45] Dec. 11, 1979

[54] MEDICAL TERMINAL CLIP MEMBER FOR ATTACHMENT TO PATIENT ELECTRODES

[75] Inventors: Roger A. Ekbom, Newport Beach; Sidney Friedlander, Encino, both of Calif.

[73] Assignee: Tronomed, Inc., Costa Mesa, Calif.

[21] Appl. No.: 841,810

[22] Filed: Oct. 13, 1977

[51] Int. Cl.[2] ..... H01R 11/22

[52] U.S. Cl. ..... 339/61 R; 339/261

[58] Field of Search ..... 339/61 R, 255 P, 261

[56] References Cited

U.S. PATENT DOCUMENTS

| | | | |
|---|---|---|---|
| 3,008,114 | 11/1961 | Adkins | 339/255 P |
| 3,183,469 | 5/1965 | Trachtenberg | 339/255 P |
| 3,914,007 | 10/1975 | Seidler | 339/255 P |
| 4,040,697 | 8/1977 | Ramsay et al. | 339/255 P |
| 4,072,388 | 2/1978 | Dunn | 339/261 |

*Primary Examiner*—Joseph H. McGlynn

*Attorney, Agent, or Firm*—Jackson, Jones & Price

[57] ABSTRACT

The medical terminal clip has a body member with a longitudinal axis and a pair of laterally spaced leg members extending in approximately the longitudinal direction and pivotally connected for relative movement. The respective spaced leg members form a variably spaced electrode receptacle on one side of the pivotal connection. A beryllium copper conductive member is embedded in the body member and is formed from a strip of metal bent into approximately an M-shape with side flanges on the leg members to provide additional strength. A shield or barrier member extends at least between the approximate ends of the leg members on the other side of the pivotal connection while permitting relative movement of the leg members. The shield member is designed to close longitudinal access to the space between the leg members and thereby prevent any dislocation of the terminal clip member by catching onto exterior objects such as other terminal wires.

11 Claims, 5 Drawing Figures

FIG. 1
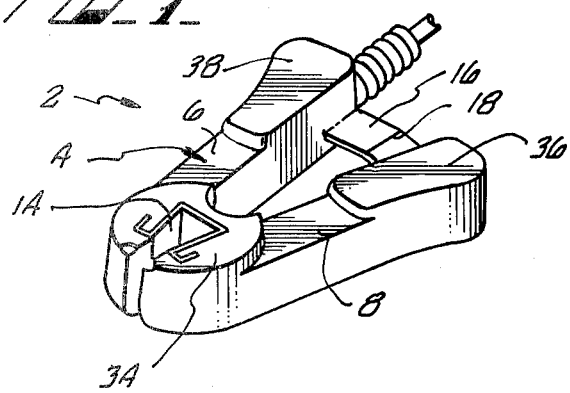
FIG. 5
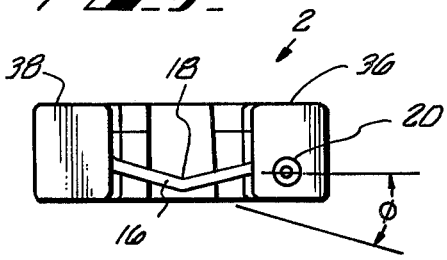
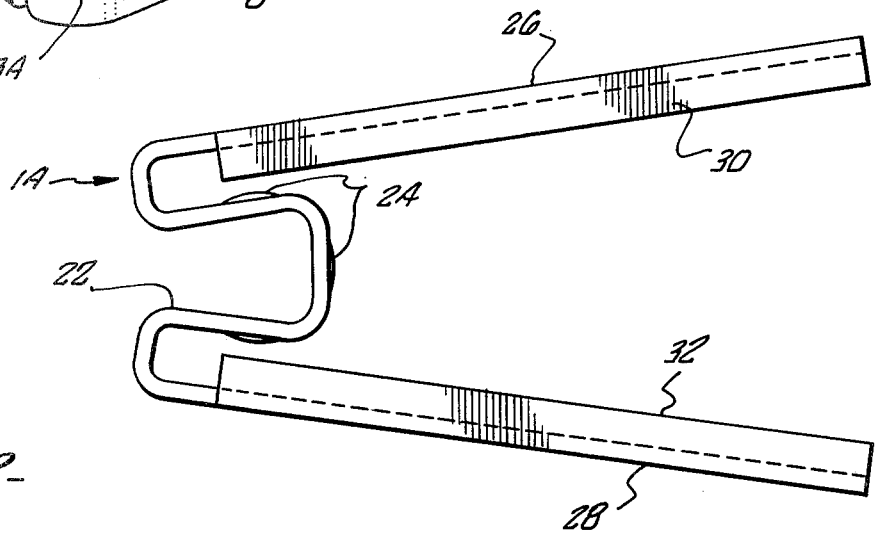
FIG. 2
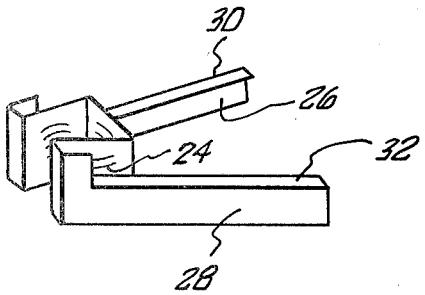
FIG. 3
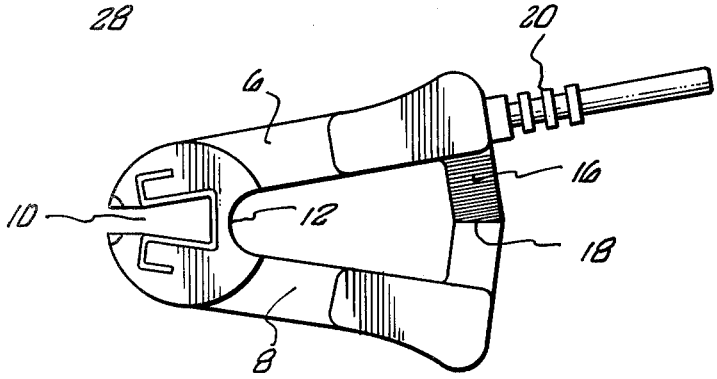
FIG. 4

MEDICAL TERMINAL CLIP MEMBER FOR ATTACHMENT TO PATIENT ELECTRODES

BACKGROUND OF THE INVENTION

1. Field of the Invention

The present invention is directed to a medical terminal clip member for attachment to electrodes connected to a patient and more particularly to a terminal clip member of improved strength and retention capabilities.

2. Description of the Prior Art

The prolification of electrical instrumentation in the medical field has created demands for a relatively inexpensive but reliable medical terminal clip member. Numerous forms of electrodes are now frequently attached to a patient's skin, for example, of the type disclosed in U.S. Pat. No. 3,993,049.

Various forms of medical terminal clips are known having a pair of spaced legs that are pivotally connected together to provide a variable electrode receptacle. An example of a medical terminal clamp in the medical field can be found in U.S. Pat. No. 3,624,590 which discloses a clamp for use with electro-surgical units having high frequency currents with an active electrode and a patient indifferent ground plate.

An additional electrical connector for use in the medical field is disclosed in U.S. Pat. No. 3,842,394. Finally, various configurations of electrical clips are broadly known in the electrical field as illustrated in U.S. Pat. Nos. 2,522,810 and 3,914,007.

The prior art is still striving to achieve the goals of providing a relatively economical, reliable and secure medical terminal clip member that can be used with confidence on a patient. As can be readily appreciated, the patient frequently will be both active and inactive and the problem of dislodging the connection of the electrical terminal member with the electrode is always present. Accordingly, the prior art is still seeking to optimize a medical terminal clip that satisfies each of the above goals.

SUMMARY OF THE INVENTION

An advantage of the present invention is that it can be relatively inexpensively manufactured while still providing superior strength and safety requirements.

The present invention is directed to a medical terminal clip member for attachment to electrodes connected to a patient and comprises a body member having longitudinal axis and a pair of laterally spaced leg members extending in the longitudinal direction and pivotally connected for relative movement. The spaced leg members form a variably spaced electrode receptacle on one side of the pivotal connection that is responsive to the relative movement of the leg members to open and close upon an electrode stud. Conductive means are supported in the body member or rather embedded when the body member is plastic. The conductive means includes an approximately M-shaped strip of conductive material wherein the upper portion of the M is exposed in the electrode receptacle and the extension portions are contained respectively in each leg member. Each of the extension portions are further bent inwardly to form a respective flange throughout the length of each leg member to provide addition strength. A flexible shield or barrier member extends at least between the approximate ends of the leg members on the other side of the pivotal connection while still permitting relative movement of the leg members. The barrier member closes the longitudinal access to the space between the leg members to prevent dislocation of the terminal clip member from the electrode by catching onto exterior objects such as other wires, clothing, sheets, etc.

The objects and features of the present invention which are believed to be novel are set forth with particularity in the appended claims. The present invention, both as to its organization and manner of operation, together with further objects and advantages thereof, may best be understood by reference to the following description, taken in connection with the accompanying drawings.

BRIEF DESCRIPTION OF THE DRAWINGS

FIG. 1 is an elevated bottom side perspective view of the medical terminal clip of the present invention;

FIG. 2 is a bottom plan view of the conductive metal strip of the present invention;

FIG. 3 is an elevated bottom side perspective view of the conductive strip of the present invention;

FIG. 4 is a bottom plan view of the medical terminal clip of the present invention; and FIG. 5 is an end view of the medical terminal clip of the present invention.

DESCRIPTION OF THE PREFERRED EMBODIMENT

The following description is provided to enable any person skilled in the medical field to make and use the invention and sets forth the best modes contemplated by the inventor of carrying out his invention. Various modifications, however, will remain readily apparent to those skilled in the art, since the generic principles of the present invention have been defined herein specifically to provide for a relatively economical, reliable and secure medical terminal clip member that can be used with confidence on a patient.

Referring to FIG. 1, a bottom elevated side perspective view of the medical terminal clip member 2 of the present invention is shown. The body member 4 basically comprises a pair of elongated leg members 6 and 8 that are connected together by a pivotal connection 12 intermediate of their ends. An electrode receptacle 10 is formed on one side of the pivotal connection 12 and has a beveled upper entrance edge to accommodate the shape of an electrode stud (not shown). The body member can be ejection molded from a polyvinyl chloride plastic and includes a conductive core or conductive means 14 that is embedded in the plastic and extends through each leg member and the electrode receptacle. The leg members 6 and 8 extend generally in the same direction as the longitudinal axis of the body member 4 and terminate in appropriately configured ends to permit ready grasping by the fingers.

To both enlarge the grasping surface of the leg members 6 and 8 and also to provide a stable support platform for bearing against the patient's body or electrode pad, a raised support pad 36 and 38 are provided on respective leg members. An additional raised support pad 38 is provided about the electrode receptacle 10 and is specifically dimensioned to be compatible with circular recesses that are frequently provided on the electrode pads. Thus, the cooperative function of the respective support pads are to permit both a secure fastening of the electrode receptable 10 into a circular recess about an electrode stud (not shown) and to contact the patient so that the body member 4 is not cantilevered from the electrode.

A bottom plan view of the conductive means 14 is shown in FIG. 2. The conductive means 14 can be formed from a strip of beryllium copper that is bent into the appropriate configuration and then heat treated to insure resiliency as known in the prior art. The copper strip is bent into approximately an M-shape with an upper portion U-shaped receptacle 22 and a pair of extension portions 26 and 28 extending outward from the U-shaped receptacle 22. The U-shaped receptacle 22 can have a plurality of circular indentations 24 to assist in seating the electrode stud. The respective extension portions 26 and 28 are cut and bent inwardly to form a respective flange 30 and 32 to further strengthen the medical terminal clip member 2. An electrical connection (not shown) can be made to one of the extension portions and preferably an electrical lead connector 20 is intrically extruded with the body member 4 for receiving an appropriate electrical wire. The electrical lead connector 20 is relatively resilient and prevents a sharp bend or break in the electrical wire at its interface with the body member 4.

Referring to FIGS. 4 and 5, a barrier member or flexible shield member 16 extends between the back edges of the respective leg members 6 and 8. As can be specifically seen from FIG. 5, the flexible shield member has a vertical cross-sectional shallow V-shape with a central crease 18 molded into the shield member 16. The angle of the respective sides of the flexible shield member 16 is approximately $\theta=20°$ to the horizontal. The shield member 16 is sufficiently thin and flexible to permit the relative movement of the leg members 6 and 8 to vary the opening of the electrical receptacle 10 without any perceptible interference. The shield member 16 is also positioned adjacent the top of the terminal clip member to provide a substantially closed and compact configuration to any exterior entrants. For the same reason, the shield member 16 is peaked outward to extend generally beyond the leg members 6 and 8 in the longitudinal direction and to provide relatively planar horizontal surfaces with the end faces of the respective leg members on either side of the extended tip.

Accordingly, the flexible shield member 16 will pivot about the crease 18 and come closer together when the respective leg members 6 and 8 are depressed to open the electrical receptacle 10. When the leg members 6 and 8 are relaxed, the flexible shield member 16 resumes its position and effectively blocks or closes any longitudinal access to the space between the leg members. By accomplishing this function the flexible shield member prevents dislocation of the terminal clip member from any electrode by preventing the leg members 6 and 8 from acting as a hook or catch for exterior objects such as other wires connected to the patient, bed clothing, sheets, etc.

While not shown, an alternative embodiment could utilize a non-flexible barrier member that could be cantilevered from one leg member and extend through a receptacle or even beyond the edge of the other leg member. This barrier member would perform the same function of preventing longitudinal access to the space between the leg members while still permitting relative movement of leg members about their pivotal connection to vary the opening of the electrode receptacle.

While the above embodiments have been disclosed as the best mode presently contemplated by the inventors, it should be realized that these examples should not be interpreted as limiting, because artisans skilled in this field, once given the present teachings, can vary from these specific embodiments.

Accordingly, the scope of the present invention should be determined solely from the following claims in which we claim:

1. A medical terminal clip member for attachment to electrodes connected to a patient comprising;

a body member made out of a relatively soft plastic material having a longitudinal axis and a pair of laterally spaced leg members extending in an approximately longitudinal direction and pivotally connected for relative movement, the spaced leg members forming a variably spaced electrode receptacle on one side of the pivotal connection;

conductive means supported by the body member and strengthening each laterally spaced leg member and further electrically connected to the electrode receptacle includes an approximately U-shaped receptacle and a pair of side members connected to and extending respectively from each end of the receptacle, each side member including a flange, and a flexible shield member having a greater width along the longitudinal axis than its thickness traverse to the longitudinal axis is formed from the plastic material, the shield member further has a recessed central crease extending along the longitudinal direction so as to form an approximately shallow V-shape in a plane traverse to the longitudinal axis whereby either side of the flexible shield member pivots about the crease and come closer together when the respective leg members are depressed to open the electrical receptacle cavity, the flexible shield closes longitudinal access to the space between the leg members to prevent dislocation of the terminal clip member from the electrode by catching onto an exterior object.

2. The invention of claim 1 wherein the side member flanges project inward towards each other.

3. The invention of claim 1 wherein the body member, leg members and flexible shield members are formed from a polyvinyl chloride plastic.

4. The invention of claim 1 wherein the approximate vertical height of the U-shaped receptacle is about twice the vertical height of the side members.

5. The invention of claim 4 wherein the conductive means includes a single strip of metal bent into approximately an M shape.

6. The invention of claim 5 wherein the conductive means is a single strip of beryllium copper.

7. The invention of claim 1 wherein the conductive means supported by the body member and leg members includes an approximately M-shaped conductive member, the upper portion of the M being exposed in the electrode receptacle cavity and forming an electrode receptacle for electrical connection and the side members embedded in the plastic leg members and extending beyond the pivotal connection and being contained respectively in each leg member, only the side members being cut and bent to form respective lateral flanges for providing additional strength to each leg member.

8. The invention of claim 7 wherein the vertical height of the upper portion of the M electrode receptacle is greater than the vertical height of the side members.

9. The invention of claim 7 wherein the approximately M-shaped conductive member is formed from a single strip of beryllium copper.

10. The invention of claim 7 wherein the plastic body member, plastic leg members and flexible shield member are molded from a polyvinyl chloride plastic.

11. The invention of claim 7 wherein the lateral flanges on each side member project inward towards each other.

* * * * *